US010663235B2

(12) United States Patent
Petersen et al.

(10) Patent No.: US 10,663,235 B2
(45) Date of Patent: May 26, 2020

(54) GASKET RETENTION SYSTEM

(71) Applicant: SPX Flow, Inc., Charlotte, NC (US)

(72) Inventors: Jes Hansen Petersen, Lunderskov (DE); Benny Kot-Jensen, Kolding (DE)

(73) Assignee: SPX Flow, Inc., Charlotte, NC (US)

( * ) Notice: Subject to any disclaimer, the term of this patent is extended or adjusted under 35 U.S.C. 154(b) by 0 days.

(21) Appl. No.: 15/914,499

(22) Filed: Mar. 7, 2018

(65) Prior Publication Data

US 2019/0219341 A1 Jul. 18, 2019

Related U.S. Application Data

(60) Provisional application No. 62/616,788, filed on Jan. 12, 2018.

(51) Int. Cl.

| | |
|---|---|
| ***F28F 3/10*** | (2006.01) |
| ***F28D 9/00*** | (2006.01) |
| ***F28F 3/08*** | (2006.01) |

(52) U.S. Cl.

CPC ..... *F28F 3/10* (2013.01); *F28D 9/005* (2013.01); *F28D 9/0093* (2013.01); *F28F 3/083* (2013.01); *F28F 2230/00* (2013.01); *F28F 2280/00* (2013.01)

(58) Field of Classification Search

CPC ..... F28F 3/10; F28F 2230/00
USPC ..... 165/166, 167
See application file for complete search history.

(56) References Cited

U.S. PATENT DOCUMENTS

| | | | | |
|---|---|---|---|---|
| 4,635,715 | A * | 1/1987 | Andersson | F28F 3/10 165/166 |
| 4,646,821 | A * | 3/1987 | Almqvist | F28F 3/10 165/166 |
| 4,995,455 | A * | 2/1991 | Mathur | F28F 3/10 165/166 |
| 5,178,212 | A * | 1/1993 | Nakamura | F28F 3/10 165/166 |
| 5,927,395 | A * | 7/1999 | Damiani | F28F 3/10 165/166 |
| 6,186,224 | B1 * | 2/2001 | Seidel | F28F 3/10 165/166 |
| 6,513,584 | B2 * | 2/2003 | Lehmann | F28F 3/10 165/166 |
| 6,899,163 | B2 | 5/2005 | Finch et al. | |
| 2015/0330720 | A1 * | 11/2015 | Hedberg | F28F 3/10 165/76 |
| 2016/0282060 | A1 * | 9/2016 | Rasmussen | F28F 3/10 |

* cited by examiner

*Primary Examiner* — Leonard R Leo
(74) *Attorney, Agent, or Firm* — BakerHostetler

(57) ABSTRACT

A gasket retention system includes a gasket and a plate. The gasket includes a loop. The loop includes a gasket tab extending from the gasket, a pair of loop arms flanking the gasket tab and extending from the gasket, a loop webbing connecting the pair of loop arms, and a loop tab extending from the loop webbing toward the gasket tab. The plate includes a loop receiving seat. The loop receiving seat includes a gasket seat, a gasket tab slot to receive the gasket tab, a loop tab channel to receive the loop tab, a pair of loop arm channels to receive the pair of loop arms, and an edge for the loop webbing to bear upon.

8 Claims, 7 Drawing Sheets

GASKET RETENTION SYSTEM

PRIORITY

This application claims priority to U.S. Provisional Application Ser. No. 62/616,788, filed Jan. 12, 2018, titled GASKET RETENTION SYSTEM, the disclosure of which is incorporated herein in its entirety.

FIELD OF THE INVENTION

The present invention relates generally to a gasket. More particularly, the present invention relates to a gasket retention system for use in a plate heat exchanger.

BACKGROUND OF THE INVENTION

It is generally known that plate heat exchangers offer efficient transfer of heat from one fluid to another in a relatively small volume. Typically, plate heat exchangers include several plates to one hundred or more of plates which are stacked together and sealed together. Relatively small plate heat exchangers are often permanently sealed together via brazing, for example. Larger plate heat exchangers are more typically sealed via gaskets disposed between the plates or between pairs of plates. Because the gasket is disposed about the perimeter of each plate and because of the number of plates in a plate pack of the plate heat exchanger, there is typically between 100 meters (m) to 5 kilometers (km) total length of gasket material in a plate heat exchangers.

Plate packs are often disassembled to maintain the plates and gaskets. If the gasket releases from the plate during disassembly, reassembly is more difficult and time consuming. While various conventional gasket retention systems have been proposed, these systems are less than ideal for one reason or another.

Accordingly, it is desirable to provide a gasket retention system for plate heat exchangers that is able to overcome the foregoing disadvantages at least to some extent.

SUMMARY OF THE INVENTION

The foregoing needs are met, to a great extent, by the present invention, where in some embodiments a gasket retention system for plate heat exchangers that is able to overcome the foregoing disadvantages at least to some extent is provided.

An embodiment of the present invention pertains to a gasket retention system having a gasket and a plate. The gasket having a loop. The loop having a gasket tab extending from the gasket, a pair of loop arms flanking the gasket tab and extending from the gasket, a loop webbing connecting the pair of loop arms, and a loop tab extending from the loop webbing toward the gasket tab. The plate having a loop receiving seat. The loop receiving seat having a gasket seat, a gasket tab slot to receive the gasket tab, a loop tab channel to receive the loop tab, a pair of loop arm channels to receive the pair of loop arms, and an edge for the loop webbing to bear upon.

Another embodiment of the present invention relates to a gasket for a plate heat exchanger. The gasket having a loop. The loop having a gasket tab extending from the gasket, a pair of loop arms flanking the gasket tab and extending from the gasket, a loop webbing connecting the pair of loop arms, and a loop tab extending from the loop webbing toward the gasket tab.

Yet another embodiment of the present invention pertains to a plate for a plate heat exchanger. The plate having a gasket seat and a loop receiving seat. The gasket seat configured to receive a gasket. The gasket includes a loop, the loop having a gasket tab extending from the gasket, a pair of loop arms flanking the gasket tab and extending from the gasket, a loop webbing connecting the pair of loop arms, and a loop tab extending from the loop webbing toward the gasket tab. The loop receiving seat having a gasket tab slot to receive the gasket tab, a loop tab channel to receive the loop tab, a pair of loop arm channels to receive the pair of loop arms, and an edge for the loop webbing to bear upon.

Yet another embodiment of the present invention relates to a plate heat exchanger having a plate pack. The plate pack including a gasket retention system. The gasket retention system having a gasket and a plate. The gasket having a loop. The loop having a gasket tab extending from the gasket, a pair of loop arms flanking the gasket tab and extending from the gasket, a loop webbing connecting the pair of loop arms, and a loop tab extending from the loop webbing toward the gasket tab. The plate having a loop receiving seat. The loop receiving seat having a gasket seat, a gasket tab slot to receive the gasket tab, a loop tab channel to receive the loop tab, a pair of loop arm channels to receive the pair of loop arms, and an edge for the loop webbing to bear upon.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
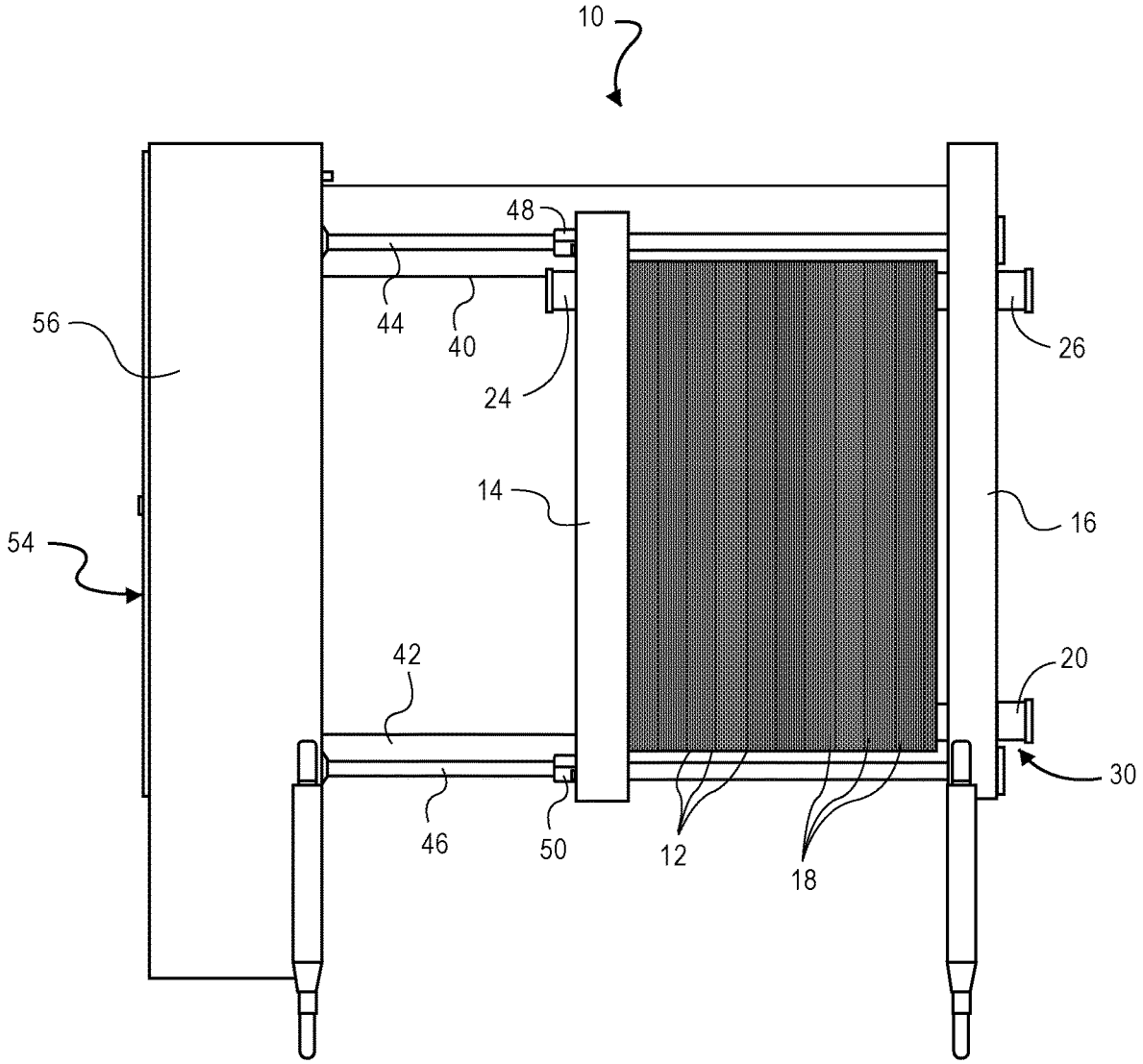
FIG. 1 is a side view of a plate heat exchanger suitable for use with a gasket according to an embodiment of the invention.

The invention will now be described with reference to the drawing figures, in which like reference numerals refer to like parts throughout. An embodiment in accordance with the present invention provides an improved gasket retention system that increases retention of the gasket in the plate. In this manner, disassembly and reassembly of the plate stack in a plate heat exchanger is improved is resistant to degradation caused by exposure to chemicals, temperature extremes, ultraviolet light, and the like. This improved gasket is further capable of providing excellent sealing characteristics and is highly resistant to material fatigue. In addition, labor costs may be reduced by the improved gasket retention system due to the improved retention, and thus, reduced slippage of the gasket from the plate during inspection, disassembly, and re-assembly of the plate heat exchanger.

FIG. 1 is a side view of a plate heat exchanger 10 suitable for use with a gasket and/or plate according to an embodiment of the invention. Of note, the gasket retention system described hereinbelow may be incorporated into any suitable plate heat exchanger having gaskets and plates. In this particular example, as shown in FIG. 1, the plate heat exchanger 10 may include tens or hundreds of heat exchange plates 18 and gaskets 12. In order to retain the heat exchange plates 18 and gaskets 12 in alignment, the plate heat exchanger 10 may include upper and lower support beams 40 and 42. The gaskets 12 may include any suitable elastomeric material suitable for sealing the cavities formed between adjacent plates 18. The plates 18 may include any suitable metallic material with sufficient rigidity, toughness, and thermal conductivity for use in the plate heat exchanger.

To compress the gaskets 12 between the heat exchange plates 18, the plate heat exchanger 10 may include threaded tie bars 44 and 46 configured to respectively mate with a threaded nut 48 and 50. The threaded nuts 48 and 50 are captured with respect to the follower 14. A drive mechanism 54 is configured to rotate the threaded tie bars 44 and 46 and, via the translation of the threaded nuts 48 and 50 along the threaded tie bars 44 and 46, the follower 14 is urged towards the head 16. The drive mechanism 54 may be disposed within a housing 56. While the drive mechanism 54 may include any suitable device capable of urging the follower 14 towards the head 16, a particularly suitable drive mechanism is described in U.S. Pat. No. 6,899,163, titled Plate Heat Exchanger and Method for Using the Same, the disclosure of which is hereby incorporated by reference in its entirety.

Figure 2:
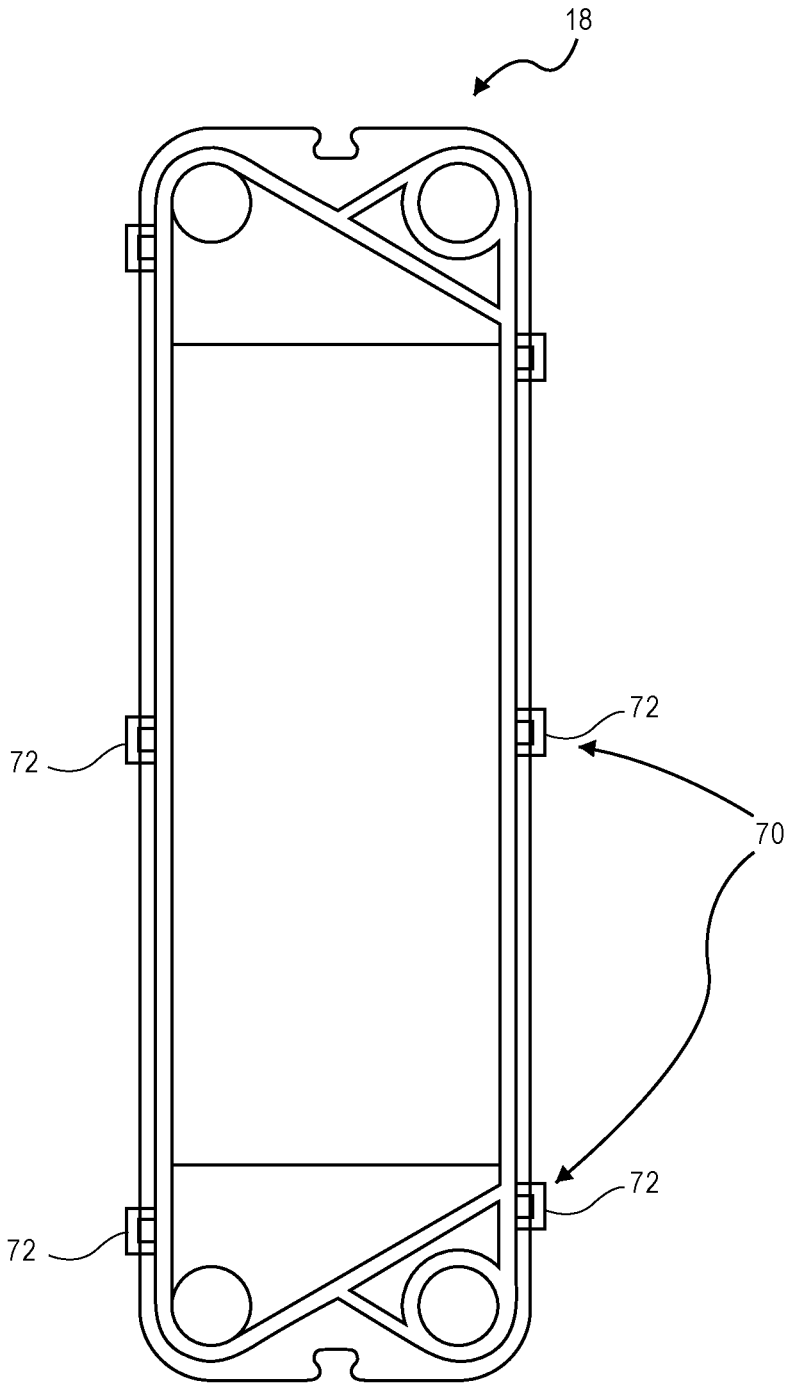
FIG. 2 is a schematic of an exemplary heat exchange plate according to an embodiment of the invention.

FIG. 2 is a schematic of an exemplary heat exchange plate 18 of the multitude of heat exchange plates 18 in the plate heat exchanger 10 shown in FIG. 1. The heat exchange plate 18 is provided with a respective gasket 12 which substantially follows the periphery of the individual heat exchange plate 18 and thus seals the cavities formed between two adjacent heat exchange plate 18 upon assembly of the plate heat exchanger 10. The gasket 12 is disposed upon a gasket seat 60. According to embodiments, the gasket 12 is secured to the heat exchange plate 18 by a gasket retention system 70. In general, the gasket retention system 70 includes engaging structures on both the gasket 12 and the heat exchange plate 18 configured to mate with one another.

Figure 3:
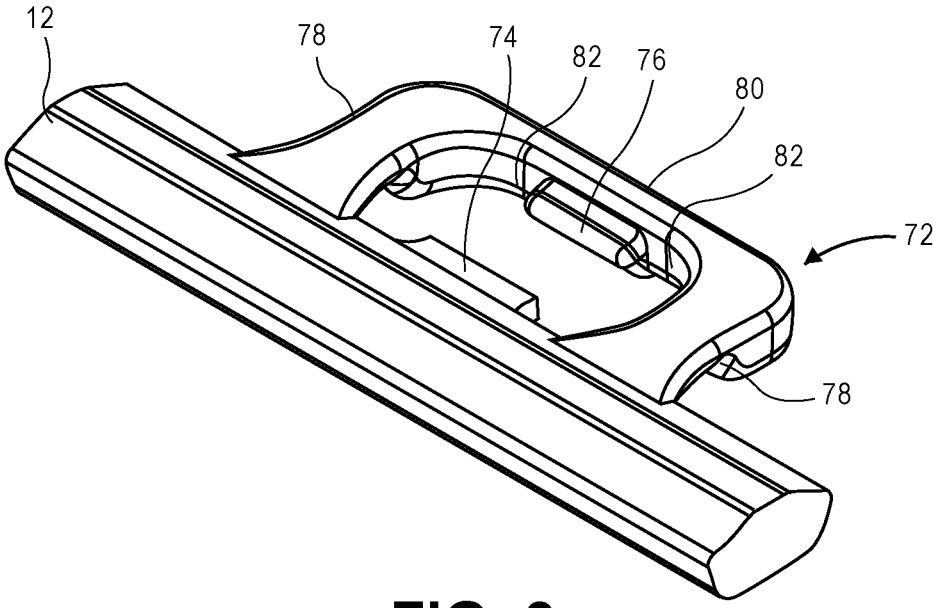
FIG. 3 is a magnified perspective view of an outer portion of the gasket in accordance with the embodiment of the invention.

With reference to FIG. 3, the engaging structures of the gasket 12 include a loop 72, a gasket tab 74, a loop tab 76, a pair of loop arms 78, and a loop webbing 80. The loop 72 extends axially from the gasket 12 via the loop arms 78. The loop arms 78 are connected at their respective proximal ends via a portion of the gasket 12 disposed therebetween. The loop arms 78 are connected at their respective distal ends via the loop webbing 80 disposed therebetween. The gasket tab 74 extends axially from the gasket 12 toward the loop tab 76. The loop tab 76 extends axially from the loop webbing 80 toward the gasket tab 74. In addition to supporting the loop tab 76, the loop webbing 80 includes a pair of bearing surfaces 82 which flank the loop tab 76.

Figure 4:
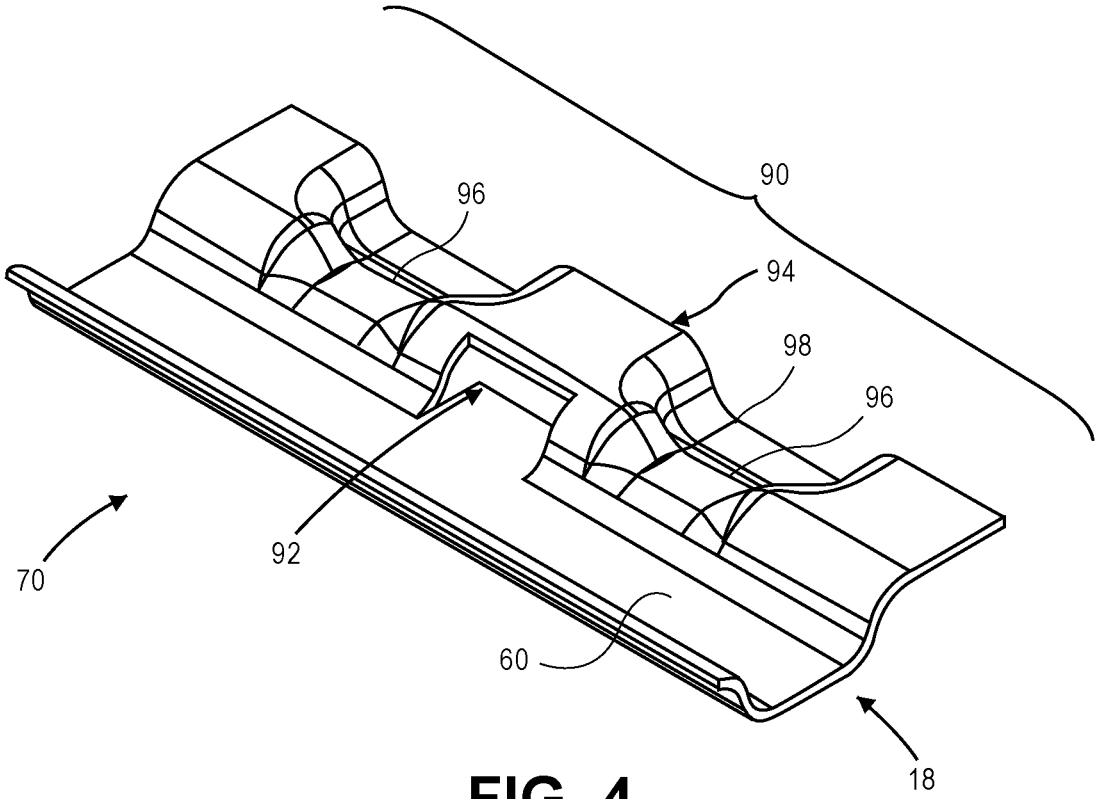
FIG. 4 is a magnified perspective view of the heat exchange plate according to an embodiment of the invention.

As shown in FIG. 4 with frequent reference back to FIG. 3, the engaging structures of the plate 18 include a loop receiving seat 90 configured to receive the loop 72. Particular elements of the loop receiving seat 90 include a gasket tab slot 92, a loop tab channel 94, a pair of loop arm channels 96 and an edge 98. The gasket tab slot 92 is configured to receive the gasket tab 74 as shown particularly in FIGS. 6 and 8. The loop tab channel 94 is configured to receive the loop tab 76 as shown particularly in FIGS. 6 and 8. The pair of loop arm channels 96 are configured to receive the respective loop arm 78 as shown particularly in FIG. 7. The edge 98 is configured to serve as a bearing surface for the pair of bearing surfaces 82.

Figure 5:
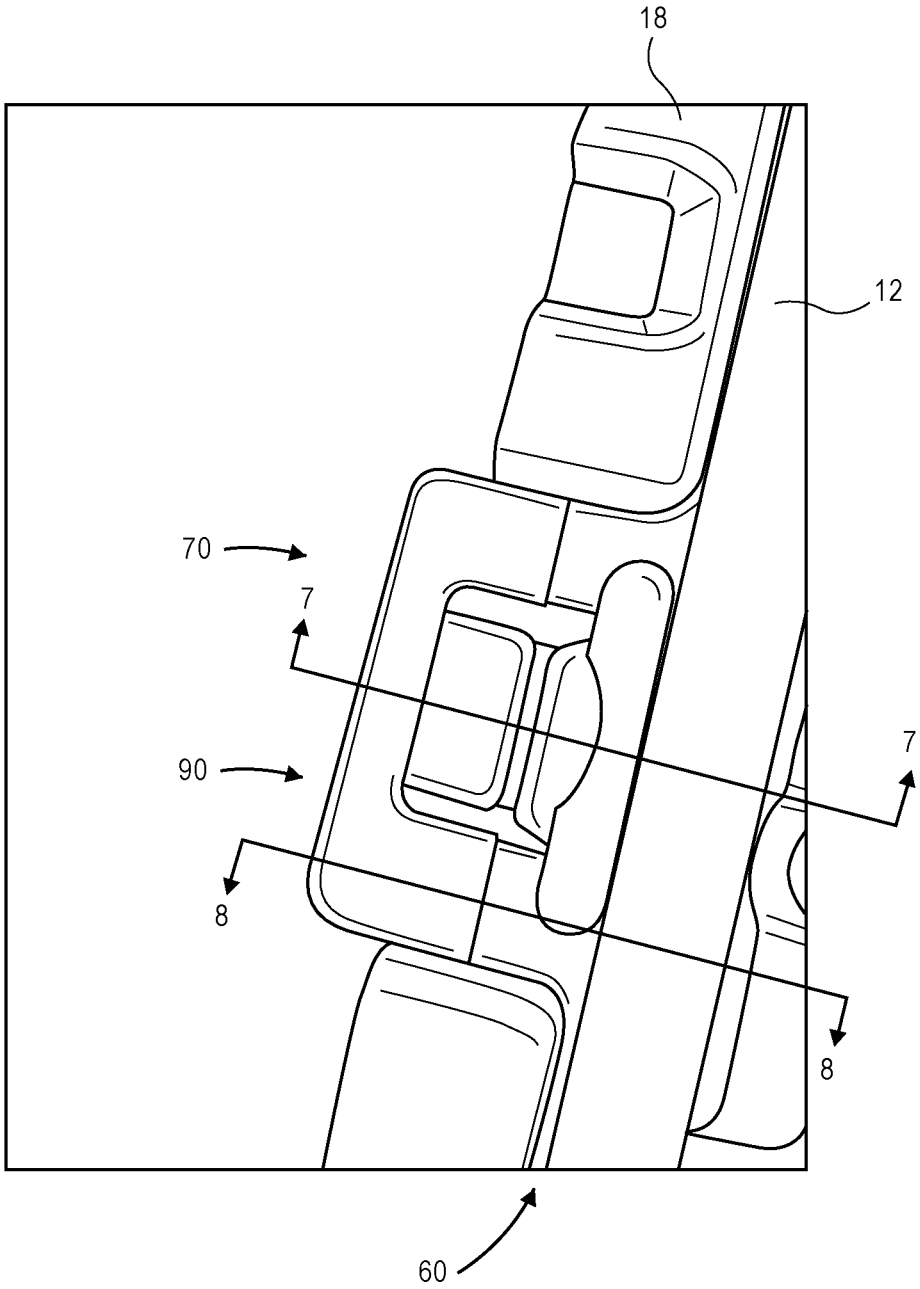
FIG. 5 is a magnified perspective top view of a gasket retention system according to an embodiment of the invention.

FIG. 5 is a top view of the gasket retention system 70. As shown in FIG. 5 the loop 72 is engaged with the loop receiving seat 90. Also shown in FIG. 5, the gasket 12 is disposed in the gasket seat 60. It is an advantage of the gasket retention system 70 that the gasket 12 is secured in the gasket seat 60 during assembly and disassembly of the plate heat exchanger 10.

Figure 6:
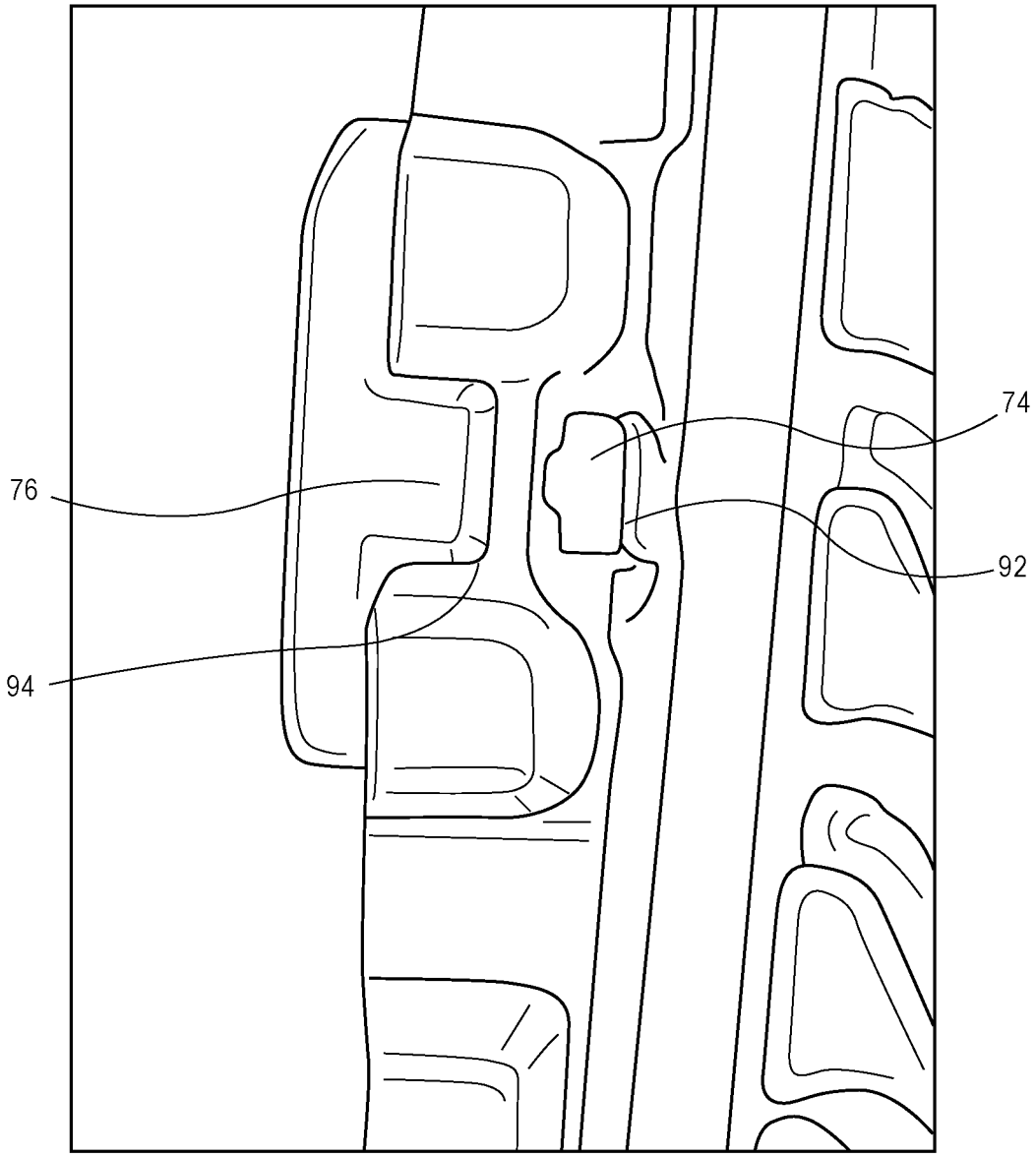
FIG. 6 is a magnified perspective bottom view of the gasket retention system according to an embodiment of the invention.
Figure 7:
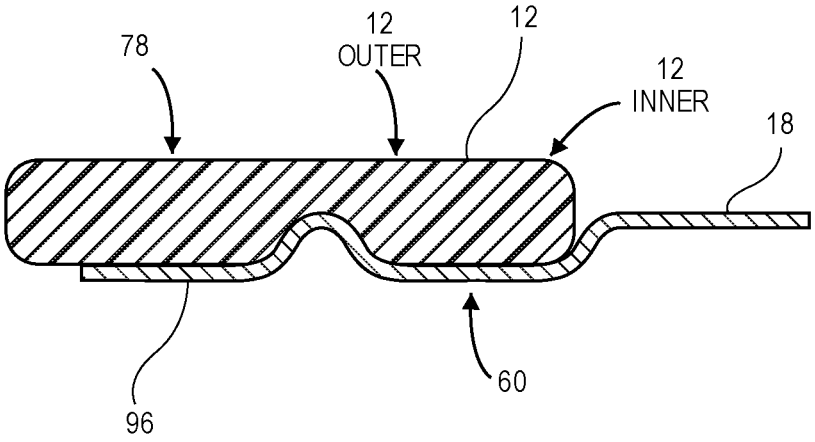
FIG. 7 is a cross sectional view 7-7 of the gasket retention system according to an embodiment of the invention.

FIG. 6 is a bottom view of the gasket retention system 70. As shown in FIG. 6, the gasket tab 74 extends through the gasket tab slot 92. Also shown in FIG. 6, the loop tab 76 is disposed in the loop tab channel 94. This opposing engagement of the gasket tab 74 with the gasket tab slot 92 on one side of the loop 72 and the loop tab 76 with the loop tab channel 94 on the other side of the loop 72 secures the loop 72 to the plate 18. For example, the engagement of the gasket tab 74 with the gasket tab slot 92 secures the proximal ends of the loop arms 78 in the loop arm channels 96.

Figure 8:
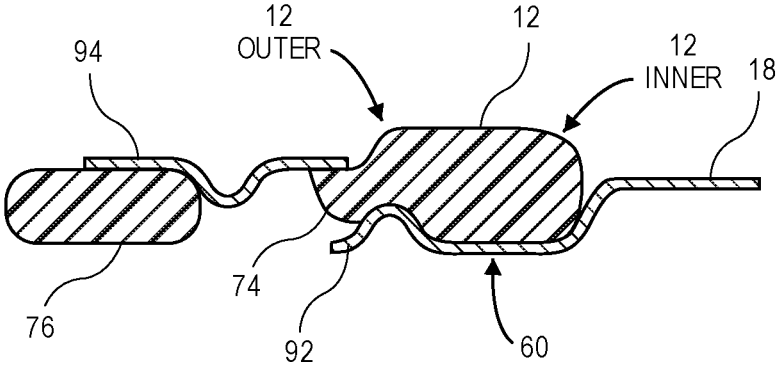
FIG. 8 is a cross sectional view 8-8 of the gasket retention system according to an embodiment of the invention.

In addition, the engagement of the gasket tab 74 with the gasket tab slot 92 secures an outer portion $\mathbf{12}_{outer}$ of the gasket 12 in the gasket seat 60 as shown in FIG. 8. The engagement of the loop tab 76 with the loop tab channel 94 secures the distal ends of the loop arms 78 in the loop arm channels 96. The loop arms 78 are configured to bear upon the loop arm channels 96. With the loop arms 78 thus secured in the loop arm channels 96, an inner portion $\mathbf{12}_{inner}$ of the gasket 12 is urged to remain seated in the gasket seat 60.

Figure 9:
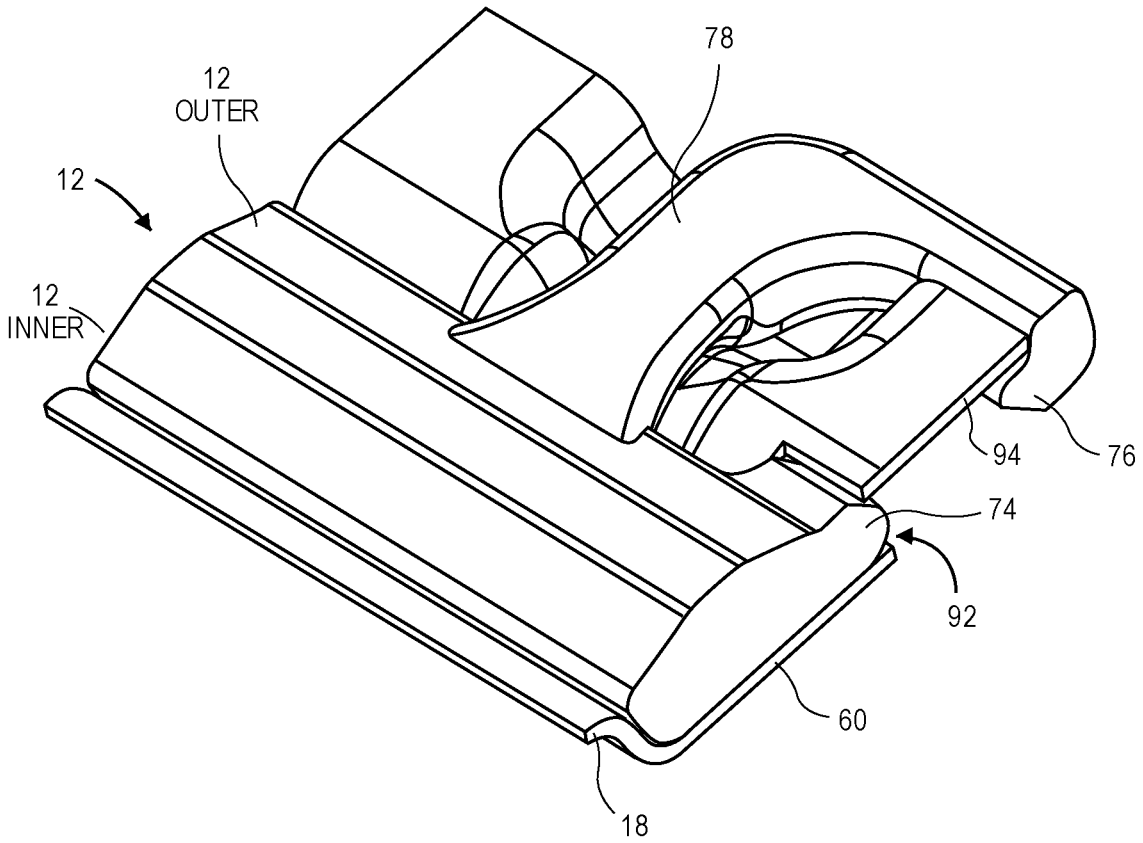
FIG. 9 is a magnified cutaway perspective top view of the gasket retention system according to an embodiment of the invention

As best shown in FIG. 9, this opposing engagement of the gasket tab 74 with the gasket tab slot 92 on one side of the loop 72 and the loop tab 76 with the loop tab channel 94 on the other side of the loop 72 secures the loop 72 to the plate 18. In this manner, the gasket 12 is secured in the gasket seat 60 due to both the outer portion $\mathbf{12}_{outer}$ of the gasket 12 and the inner portion $12_{inner}$ of the gasket 12 being urged to remain seated in the gasket seat 60.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A gasket retention system comprising:

a gasket having a loop, the loop having:

a gasket tab extending from the gasket;

a pair of loop arms flanking the gasket tab and extending from the gasket, each loop arm of the pair of loop arms having a respective concave portion proximal to the gasket, wherein each loop arm is thinner at the respective concave portion relative to the respective loop arm before and after the concave portion;

a loop webbing connecting the pair of loop arms; and a loop tab extending from the loop webbing toward the gasket tab to generate an opposing engagement with the gasket tab; and a plate having a loop receiving seat, the loop receiving seat having:

a gasket seat;

a gasket tab slot to receive the gasket tab;

a loop tab channel to receive the loop tab;

a pair of loop arm channels to receive the pair of loop arms, each loop arm channel of the pair of loop arm channels having a respective convex portion proximal to the gasket seat, wherein each convex portion is configured to cooperatively engage the respective concave portion; and an edge for the loop webbing to bear upon, wherein the loop is secured to the loop receiving seat by the opposing engagement with the gasket tab defined as an engagement of the gasket tab in the gasket tab slot to secure an engagement of the loop webbing upon the edge of the plate and the engagement of the loop webbing upon the edge of the plate to secure the engagement of the gasket tab in the gasket tab slot.

2. The gasket retention system according to claim 1, wherein the gasket is elastomeric and the plate is metallic.

3. The gasket retention system according to claim 1, further comprising:

a plate pack including a plurality of the plates alternately stacked with a plurality of the gaskets.

4. The gasket retention system according to claim 3, further comprising:

a plate heat exchanger including a head and a follower configured to receive the plate pack.

5. A plate heat exchanger comprising:

a plate pack, the plate pack including a gasket retention system, the gasket retention system comprising:

a gasket having a loop, the loop having:

a gasket tab extending from the gasket;

a pair of loop arms flanking the gasket tab and extending from the gasket each loop arm of the pair of loop arms having a respective concave portion proximal to the gasket, wherein each loop arm is thinner at the respective concave portion relative to the respective loop arm before and after the concave portion;

a loop webbing connecting the pair of loop arms; and a loop tab extending from the loop webbing toward the gasket tab to generate an opposing engagement with the gasket tab; and a plate having a loop receiving seat, the loop receiving seat having:

a gasket seat;

a gasket tab slot to receive the gasket tab;

a loop tab channel to receive the loop tab;

a pair of loop arm channels to receive the pair of loop arms, each loop arm channel of the pair of loop arm channels having a respective convex portion proximal to the gasket seat, wherein each convex portion is configured to cooperatively engage the respective concave portion; and an edge for the loop webbing to bear upon, wherein the loop is secured to the loop receiving seat by the opposing engagement with the gasket tab defined as an engagement of the gasket tab in the gasket tab slot to secure an engagement of the loop webbing upon the edge of the plate and the engagement of the loop webbing upon the edge of the plate to secure the engagement of the gasket tab in the gasket tab slot.

6. The plate heat exchanger according to claim 5, wherein the gasket is elastomeric and the plate is metallic.

7. The plate heat exchanger according to claim 5, wherein the plate pack includes a plurality of the plates alternately stacked with a plurality of the gaskets.

8. The plate heat exchanger according to claim 7, further comprising:

a head and a follower configured to receive the plate pack.

* * * * *